US005680170A

United States Patent [19]

Taniguchi et al.

[11] Patent Number: 5,680,170

[45] Date of Patent: Oct. 21, 1997

[54] THERMAL PRINTHEAD

[75] Inventors: Hideo Taniguchi; Toshihiko Takakura; Hideaki Hoki; Masatoshi Nakanishi, all of Kyoto, Japan

[73] Assignee: Rohm Co. Ltd., Japan

[21] Appl. No.: 583,037

[22] PCT Filed: May 29, 1995

[86] PCT No.: PCT/JP95/01033

§ 371 Date: Jan. 16, 1996

§ 102(e) Date: Jan. 16, 1996

[87] PCT Pub. No.: WO95/32867

PCT Pub. Date: Dec. 7, 1995

[30] Foreign Application Priority Data

| | | | |
|---|---|---|---|
| May 31, 1994 | [JP] | Japan | 6-119004 |
| Nov. 30, 1994 | [JP] | Japan | 6-297650 |

[51] Int. Cl.[6] ..... B41J 2/335

[52] U.S. Cl. ..... 347/208; 347/208

[58] Field of Search ..... 347/201, 208, 347/202, 200, 205

[56] References Cited

U.S. PATENT DOCUMENTS

| | | | |
|---|---|---|---|
| 4,630,073 | 12/1986 | Hashimoto | 346/76 |
| 4,835,548 | 5/1989 | Nikadio et al. | 347/205 |
| 5,091,736 | 2/1992 | Narita | 347/208 |
| 5,148,188 | 9/1992 | Ota et al. | 347/208 |
| 5,272,489 | 12/1993 | Kobayashi et al. | 347/208 |
| 5,361,086 | 11/1994 | Tagashira | 347/208 |
| 5,483,736 | 1/1996 | Ohnishi | 347/201 |

FOREIGN PATENT DOCUMENTS

| | | | |
|---|---|---|---|
| 0 395 001 | 10/1990 | European Pat. Off. . | |
| 40 16 935 | 11/1991 | Germany . | |
| 61-12358 | 1/1986 | Japan | 347/206 |
| 62-227764 | 10/1987 | Japan | B41J 3/20 |
| 63-309467 | 12/1988 | Japan | 347/208 |
| 1-61265 | 3/1989 | Japan | 347/208 |
| 1-255564 | 10/1989 | Japan | B41J 2/20 |
| 1-304960 | 12/1989 | Japan | 347/208 |
| 2-179765 | 7/1990 | Japan | B41J 2/345 |
| 2-253967 | 10/1990 | Japan | B41J 2/335 |
| 4-19155 | 1/1992 | Japan | B41J 2/335 |
| 4-173258 | 6/1992 | Japan | B41J 2/335 |
| 2 218 942 | 11/1989 | United Kingdom . | |

*Primary Examiner*—Huan H. Tran

*Attorney, Agent, or Firm*—Michael D. Bednarek; Kilpatrick Stockton LLP

[57] ABSTRACT

A thermal printhead according to the present invention includes an insulating head substrate (8) having an obverse surface (8*a*), a reverse surface (8*b*), a first longitudinal edge surface (8*c*) and a second longitudinal edge surface (8*d*). The surface (8*a*) of the head substrate (8) is formed with an array of heating dots (10*a*) along the first longitudinal edge surface (8*c*), a common electrode pattern (11) electrically connected to the array of heating dots (10*a*) adjacent to the first longitudinal edge surface (8*c*) and individual electrodes (12) extending away from the common electrode pattern (11) and being electrically connected to the respective heating dots (10*a*). The heating dots (10*a*) are selectively heated by drive elements. The common electrode pattern (11) is electrically connected to an auxiliary electrode layer (14) which covers at least the first longitudinal edge surface (8*c*), reverse surface (8*b*) and second longitudinal edge surface (8*d*) of the heat substrate (8).

13 Claims, 10 Drawing Sheets

THERMAL PRINTHEAD

TECHNICAL FIELD

The present invention relates to a thermal printhead, particularly to a structure provided for a head substrate of a thermal printhead.

BACKGROUND ART

Thermal printheads have been widely used for a printer of an OA apparatus such as a facsimile machine, a printer of a ticket vending machine and a label printer. As is commonly known, a thermal printhead selectively provides heat to a printing medium such as thermosensitive paper or thermal-transfer ink ribbon to form needed image information.

In general, thermal printheads are divided mainly into thin film-type thermal printheads and thick film-type thermal printheads depending upon methods of forming their heating resistors and electrode conductor layers for example. In a thin film-type thermal printhead, a heating resistor and an electrode conductor layer are made in the form of a thin film on a substrate or a glass glaze layer by sputtering for example. On the other hand, in a thick film-type thermal printhead, at least the heating resistor is made in the form of a thick film through such steps as screen printing and sintering. The present invention is applicable to both the thin film-type and thick film-type thermal printheads.

For convenience of an explanation, a structure of a typical thick film-type thermal printhead by the prior art is shown in FIG. 14. The thermal printhead shown in the figure comprises an insulating head substrate 21 made of e.g. ceramic material. The head substrate 21 has an obverse surface formed with a glass glaze layer 22 as a heat reservoir, whereas the surface of the glaze layer 22 is formed with a linear heating resistor 23 in the form of a thick film. Further, the surface of the glaze layer 22 is formed with a common electrode pattern 22 having comb-like teeth electrically connected to the heating resistor 23 and with a plurality of individual electrodes 25 electrically connected to the same heating resistor 23, wherein the comb-like teeth of the common electrode pattern 25 divide the linear heating resistor 23 into a plurality of heating dots.

Further, the surface of the glaze layer 22 is formed with a plurality of drive ICs 26 to supply an electric current to the heating resistor 23, wherein each drive IC 26 is connected, via bonding wires 27, to a predetermined portion of the individual electrode 25 and to a predetermined portion of a circuit pattern (not shown) which is formed on the glaze layer 22. The drives IC 26 are enclosed together with the bonding wires 27 by a protecting resin body.

In operation, with the common electrode pattern 24 being kept at a predetermined electrical potential, the heating dots of the heating resistor 23 are selectively actuated to generate heat by selectively passing a current from the drive ICs via the individual electrodes 25. As a result, predetermined images are formed on a printing medium (thermosensitive paper for example) 30 which is backed up by a platen 29.

In the case of a thermal printhead having the above-described structure, a heating resistor 23 is preferably formed as close to a longitudinal edge of the head substrate 21 as possible. This is because the arrangement wherein the heating resistor 23 is formed adjacent to the longitudinal edge of the head substrate 21 advantageously serves not only to avoid interference of the printing medium 30 and the protecting resin body 28 with each other, but also to highten degrees of positioning freedom and printing quality, by holding the head substrate 21 relative to the platen 29 at a certain angle.

However, if the heating resistor 23 is provided adjacent to the longitudinal edge of the head substrate 21, spacing for formation of the common electrode pattern 22 is rendered correspondingly small, thereby failing to ensure a sufficient current capacity (current passage) necessary for heat generation. As a result, the resistance of the common electrode pattern 24 may become disadvantageous, causing irregularities of generated heat between the heating dots due to a voltage drop in the longitudinal direction of the heating resistor 23, so that printing quality will deteriorate. Particularly in the case of color printing, which has been coming into wider use recently, it is extremely important to ensure a large current capacity, since all of the heating dots are frequently heated simultaneously to perform so-called solid printing.

To meet such a demand, it might be conceivable to enlarge the width of the head substrate 21 for provision of spacing which will enable formation of a common electrode pattern having a sufficient current capacity between the heating resistor 23 and the longitudinal edge of the heat substrate 21. However, such a solution may lead to an increase in size of the head substrate 21, which is contrary to the general demand for a size reduction of a thermal printhead.

DISCLOSURE OF THE INVENTION

Therefore, an object of the present invention is to provide a thermal printhead which can meet the demand for a size reduction and also can prevent quality deterioration of printed images by ensuring a sufficient current capacity, even when frequently performing solid printing as in the case of color printing for example.

To realize the object described above, according to the present invention, there is provided a thermal printhead comprising: an insulating head substrate having an obverse surface, a reverse surface, a first longitudinal edge surface and a second longitudinal edge surface; an array of heating dots formed on the obverse surface of the head substrate along the first longitudinal edge surface; a common electrode pattern electrically connected to the array of heating dots on the obverse surface of the head substrate adjacent to the first longitudinal edge surface; individual electrodes formed on the obverse surface of the head substrate to extend away from the common electrode pattern, the individual electrodes being electrically connected to the respective heating dots; and drive means for selectively actuating the heating dots to generate heat; wherein the common electrode pattern is electrically connected to an auxiliary electrode layer which covers at least the first longitudinal edge surface of the head substrate.

With the above structure, the auxiliary electrode layer electrically connected to the common electrode pattern serves to enlarge a current passage, thereby reducing the resistance to the current. Therefore, even when performing solid printing where all of the heating dots are simultaneously heated, there is hardly any occurrence of an voltage drop in the longitudinal direction of the head substrate so that the quality of printed images will not deteriorate. Besides, since the auxiliary electrode layer is formed by making use of the first longitudinal edge surface of the head substrate, there is no need to enlarge the width of the head substrate for formation of the auxiliary electrode layer. Therefore, the demand for a small-sized thermal printhead can be simultaneously met.

The auxiliary electrode layer may be formed to cover the reverse surface, or both the reverse surface and the second longitudinal edge surface of the head substrate. Such an arrangement can realize an additional enlargement of the current passage.

According to a preferred embodiment, the first edge surface of the head substrate comprises a step portion adjacent to the obverse surface, wherein the common electrode pattern extends onto the step portion, and the auxiliary electrode layer also extends onto the step portion for electrical connection to the common electrode pattern. With such an arrangement, the electrical conduction between the common electrode pattern and the auxiliary electrode layer can be further improved.

The obverse surface of the head substrate may be formed with a glaze layer having a convex portion adjacent to the first longitudinal edge surface. In this case, if the array of heating dots is formed on the convex portion of the glaze layer and the center line of the array of heating dots is cause to deviate from the apex line of the convex portion toward the first longitudinal edge surface of the head substrate, the head substrate can advantageously contact with a platen at a large contact angle, thereby improving the printing quality. The glaze layer may be formed to substantially entirely cover the obverse surface of the head substrate and to have a flat portion continuous with the convex portion. Alternatively, the glaze layer may be a partial glaze layer having the convex portion alone. The head substrate and the drive means are advantageously juxtaposed on a separate insulating support board.

The heating dots may be constituted by a thin film resistor layer patterned on the obverse surface of the head substrate. In this case, the common electrode pattern and the individual electrodes are to be formed on the resistor layer. The common electrode pattern may comprise a layer made of chromium. Further, the individual electrode is preferably formed to comprise a first layer made of chromium and a second layer made of a metal other than chromium, wherein the second layer extends toward the array of heating dots but only up to a point short of the extent to which the first layer extends.

On the other hand, the array of heating dots may be constituted by a continuous thick film resistor formed in a line.

Other objects, features and advantages of the present invention will become apparent from the following detailed description of the preferred embodiments given with reference to the accompanying drawings.

BEET MODE FOR CARRYING OUT THE INVENTION

Figure 1:
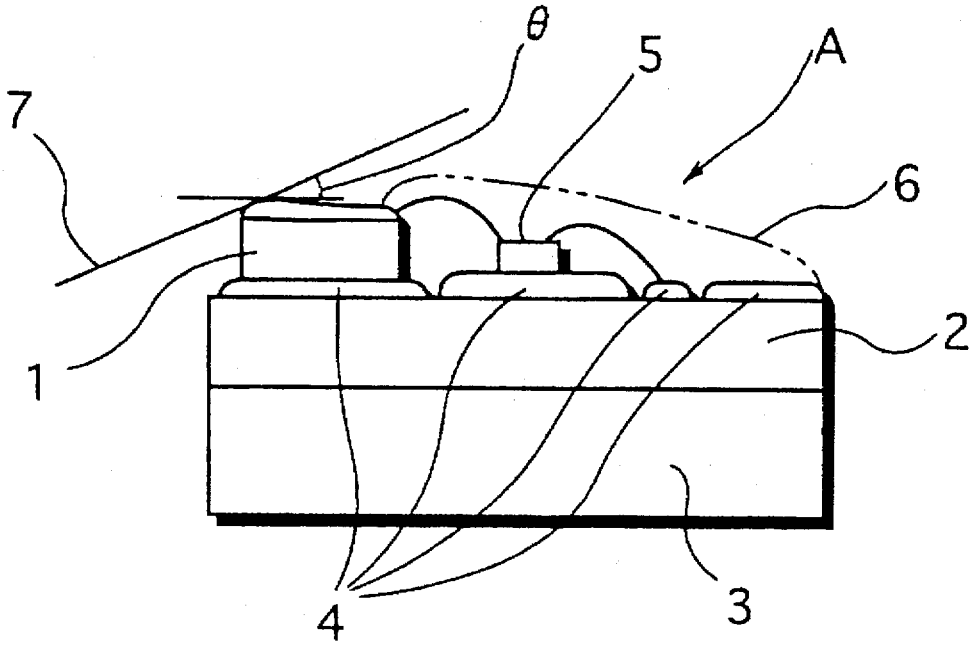
FIG. 1 is a side view showing a thermal printhead according to a first embodiment of the present invention.

Preferred embodiments of the present invention will be described below with reference to the accompanying drawings. Throughout the accompanying drawings, same or like parts are designated by the same reference numerals and characters.

Figure 2:
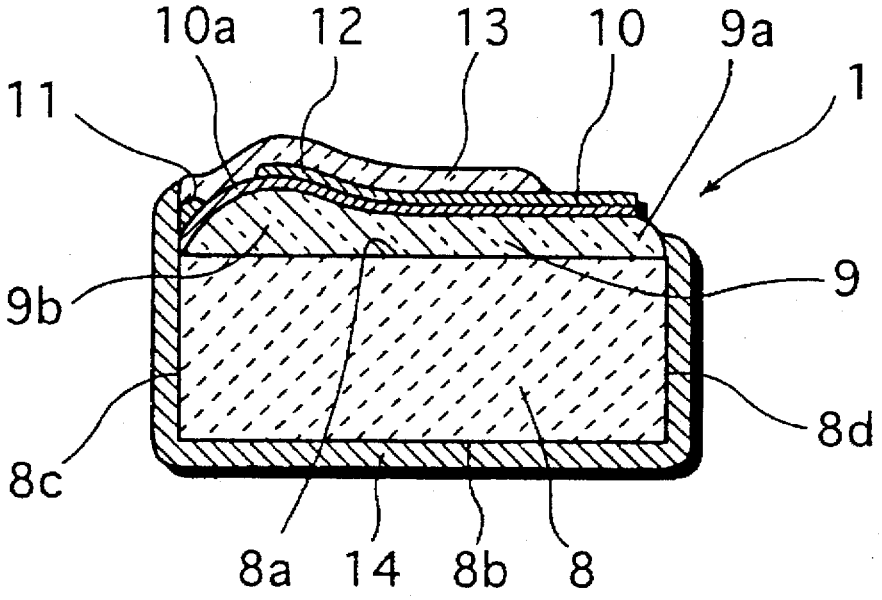
FIG. 2 is a sectional view showing a head member of the same thermal printhead.
Figure 3:
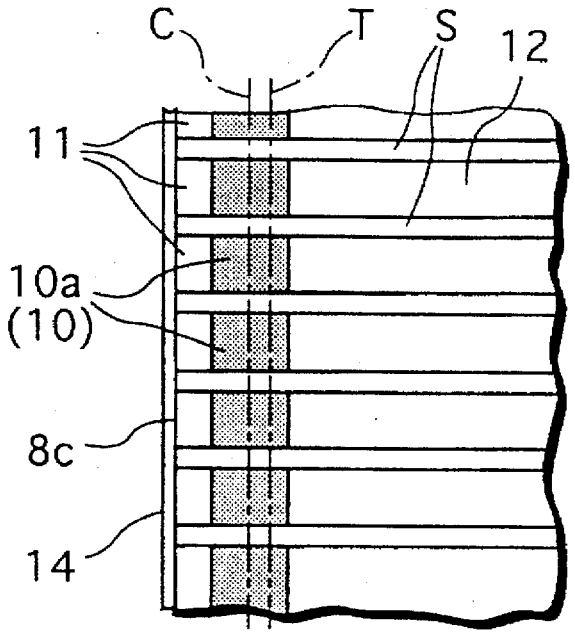
FIG. 3 is a fragmentary plan view showing a primary part of the head member shown in FIG. 2.

FIGS. 1–3 show a thermal printhead according to a first embodiment of the present invention. The thermal printhead according to the first embodiment, which is generally represented by reference sign A, mainly comprises a head member 1, a support board 2 and a heat-radiating plate 3.

The support board 2 made of an insulating material such as ceramic has a surface which is formed with conductor circuit patterns 4, as shown in FIG. 1. The surface of the support board 2 is also formed with a plurality of drive ICs 5 (only one of them shown) together with the head member 1. Each of the drive ICs 5 is electrically wire-bonded partly to the head member 1 and otherwise electrically wire-bonded to a predetermined portion of the conductor circuit pattern 4. The reverse surface of the support board 3 is fixed on the heat-radiating plate 4 made of high thermal conductivity metal such as aluminum. As a result, heat which is transmitted from the head member 1 to the support board 2 will be quickly dissipated into the atmosphere via the heat-radiating plate 3.

Figure 14:
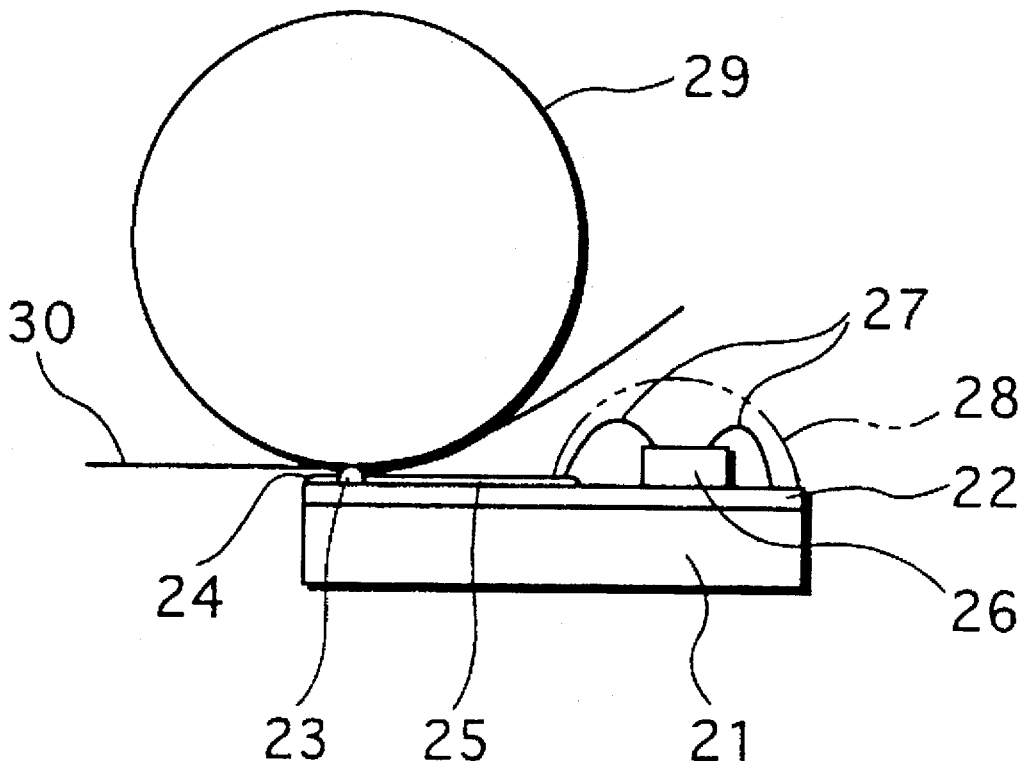
Fig. 14 Prior Art
FIG. 14 is a schematic side view showing a prior art thermal printhead.

The drive ICs 5 are enclosed by a protecting resin member 6 together with the bonding wires used for electrical conduction. However, since the drive ICs 5 are mounted not on the head member 1, but on the support board 2 together with the head member 1 beside them, the upper surface of the head member 1 can be raised higher than the upper surface of each drive IC 5 (see FIG. 1). As a result, degree of projection of the protecting resin member 6 above the upper surface of the head member 1 can be rendered smaller than that of the structure of the prior art shown in FIG. 14. Correspondingly, the protecting resin member 6 may cause less interference with a printing medium 7 (such as thermosensitive paper) which is backed up by the platen (not shown) while printing.

As shown in FIG. 2, the head member 1 comprises a head substrate 8 made of an insulating material such as ceramic, wherein the head substrate 8 having a rectangular cross section comprises an obverse surface 8*a*, a reverse surface 8*b* opposite to the obverse surface 8*a*, a first longitudinal edge surface 8*c* and a second longitudinal edge surface 8*d* opposite to the first longitudinal edge surface 8*c*. The surface 8*a* of the head substrate 8 is formed with a glass glaze layer 9 as a heat reservoir member, whereas the glaze layer 9 comprises a flat portion 9*a* having a surface generally parallel to the obverse surface 8a of the head substrate 8, and a convex portion 9b raised above the flat portion 9a.

A surface of the glaze layer 9 is formed with a resistor layer 10 in the form of a thin film. The resistor strip 10, which is divided by slits S (see FIG. 3) at a predetermined pitch, extends transversely of the head substrate 8 (that is, in the direction perpendicular to the longitudinal edge surfaces 8c, 8d of the head substrate 8).

As shown in FIGS. 2 and 3, the resistor layer 10 has a surface formed with a common electrode pattern 11 adjacent to the first longitudinal edge surface 8c of the head substrate 8, and with individual electrodes 12 which are spaced from the common electrode pattern 11 and extend from the convex portion 9b of the glaze layer 9 toward the second longitudinal edge surface 8d of the head substrate 8. The slits S extend to the common electrode pattern 11, separating the individual electrodes 12 electrically from each other.

As described above, the individual electrodes 12 are spaced from the common electrode pattern 11. Therefore, the resistor layer 10 is exposed between the common electrode pattern 11 and the individual electrodes, wherein the exposed portions constitute heating dots (heating regions) 10a, which extend in a line along the first longitudinal edge surface 8c of the head substrate 8.

In the case of the present embodiment, as shown in FIG. 3, a center line C, which runs through the respective heating dots 10a, is caused to deviate from an apex line T of the convex portion 9b of the glaze layer 9 toward the first longitudinal edge surface 8c of the head substrate 8. Therefore, as shown in FIG. 1, the head member 1 can be caused to contact with the printing medium 7 at an inclination angle (contact angle) θ. Besides, by adjusting the deviation of of the center line C from the apex line T, the contact angle θ can be made large, up to be about 30° (or more).

The contact angle θ in question is precisely defined as the angle the head member 1 makes with respect to the tangential line at the contact point of the platen (not shown). Actually, the printing medium 7 is in the form of an arc, being backed up by the platen.

On the other hand, the contact angle θ can be made to approach zero by setting the deviation of the center line C from the apex line T to be small or even zero. In this case again, as already described, the printing medium 7 does not interfere with the protecting resin body 6, since the upward projection of the protecting resin body 6 is made small relative to the head member 1.

It is not necessary for the convex portion 9b of the glaze layer 9 to project upwardly beyond the flat portion 9a. The convex portion 9b can be made in the form of an arc whose height gradually decreases from the flat portion 9a. In this case, the apex line T coincides with the boundary line between the convex portion 9b and the flat portion 9a.

In the present embodiment, as shown in FIG. 2, the heating regions (heating dots) 10a of the resistor layer 10, the common electrode pattern 11 and the individual electrodes 12 are covered with a protecting layer 13. The protecting layer 13 serves to prevent the heating regions 10a of the resistor layer 10, the common electrode pattern 11 and the individual electrodes 12 from being oxidized by exposure to the air or from being worn away due to the contact with the printing medium 7 (see FIG. 1).

The common electrode pattern 11 is exposed from the protecting layer 13 on the side of the first longitudinal edge surface 8c of the head substrate 8 for electrical connection to an auxiliary electrode layer 14 made of metal such as aluminum. Therefore, all portions of the common electrode pattern 11 are electrically connected to each other via the auxiliary electrode layer 12, thereby being kept at a same electrical potential. In other words, the auxiliary electrode layer 12 functions as a common connecting member for all parts of the common electrode pattern 11.

In the present embodiment, the auxiliary electrode layer 14 covers the whole of the first longitudinal edge surface 8c, the reverse surface 8b and the second longitudinal edge surface 8d of the head substrate 8. On the side of the first longitudinal edge surface 8c, the auxiliary electrode layer 12 extends beyond the common electrode pattern 11 to reach the protecting layer 13. Thus, the auxiliary electrode layer 12 has a large area. Therefore, the current passage is enlarged, thereby serving to substantially eliminate the voltage drop across the head member 1 in its longitudinal direction. As a result, a sufficient current can be passed even when all of the heating dots 10a are simultaneously actuated for heating (so-called solid printing), thereby preventing deterioration of the printing quality. Further, since the enlargement of the current passage is realized by forming the auxiliary electrode layer 12 over the first longitudinal edge surface, the reverse surface 8b and the second longitudinal edge surface 8d of the head substrate 8, there is no need to enlarge the width of the head substrate 8, thereby enabling a compact formation of the head member 1 and the thermal printhead A as a whole.

When the head member 1 is to be mounted on the support board 2 (see FIG. 1), the head member 1 can be advantageously electrically connected to a predetermined portion of the circuit patterns 4 of the support board 2 by using conductive adhesive containing e.g. particulate silver, since the auxiliary electrode layer 14 extends over the reverse surface 8b of the head substrate 8. Alternatively, the head member 1 can be mounted on the support board 2 by soldering, when the auxiliary electrode layer 14 is made of e.g. aluminum (Al) and nickel (Ni)-plated.

The auxiliary electrode layer 14 may be formed to cover only the first longitudinal edge surface 8c of the head substrate 8. In this case again, when the head member 1 is to be mounted on the support board 2, the auxiliary electrode layer 14 can be advantageously electrically connected to a predetermined portion of the circuit patterns 4 on the support board 2 by soldering, since the auxiliary electrode layer 14 extends toward the reverse surface 8b of the head substrate 8.

Figure 4:
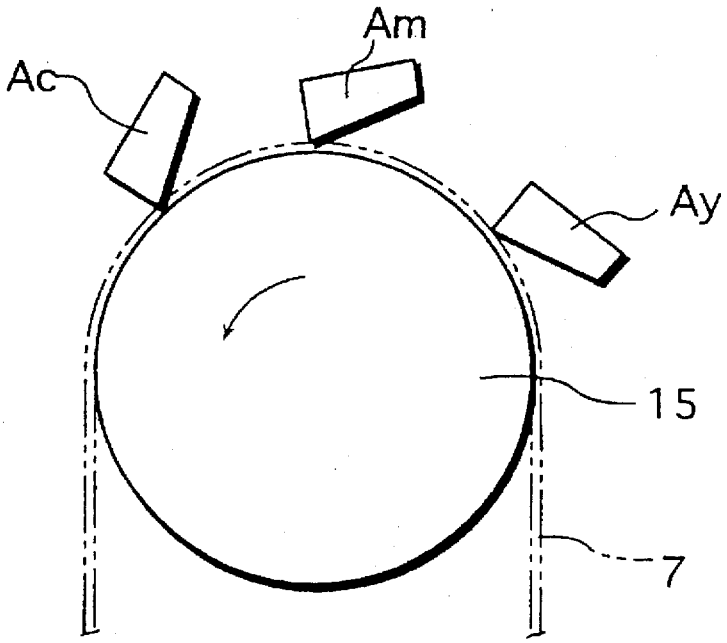
FIG. 4 is a side view schematically showing an example of usage of the thermal printhead shown in FIG. 1.

FIG. 4 shows an example of usage of the thermal printhead A having the above structure. In this example, three thermal printheads Ay, Am, Ac each having the same structure are provided to be in facing relation with the platen 15 to perform color printing to the printing medium 7. Of these, the thermal printhead Ay performs yellow-printing, the thermal printhead Am performs red (magenta)-printing and the thermal printhead Ac performs blue (cyanogen)-printing.

For color printing, in general, electric current to be used tends to become large in amount due to frequent use of solid printing. Therefore, as shown in FIG. 2, it is particularly advantageous for the head member 1 of the respective thermal printheads Ay, Am, Ac to be capable of accommodating a large current with the use of the auxiliary electrode layer 14. Besides, limitations to the spacing for arrangement of the three thermal printheads Ay, Am, Ac can be reduced because of the size reduction as already described, while allowing a large current. It is also advantageous that the contact angle of the thermal printhead (head member 1) relative to the platen 15 can be made large, since a large contact angle contributes to the economy of spacing for the arrangement and also to improvement of printing quality by increasing the contact pressure against the platen 15.

Next, an example of method of making the head member 1 of the thermal printhead A according to the above embodiment will be described with reference to FIGS. 5a–5j.

Figure 5A:
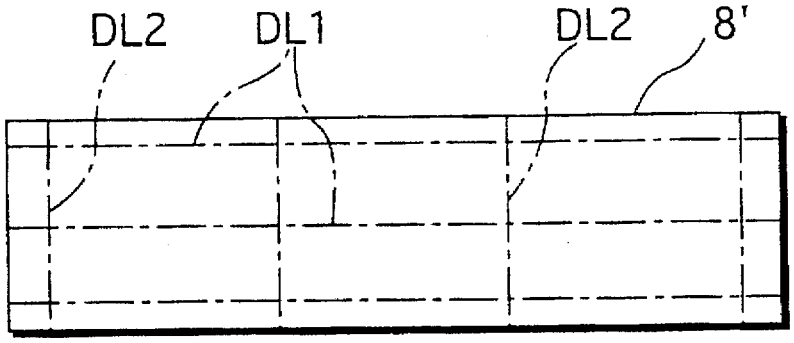
FIGS. 5*a*–5*j* show sequential steps for making the head member shown in FIGS. 2 and 3.

First, as shown in FIG. 5a, an alumina-ceramic master substrate 8' corresponding to a plurality of head substrates in size is prepared. The master substrate 8' will be divided along longitudinal division lines DL1 and transverse division lines DL2 to provide a plurality of head substrates.

Figure 5B:
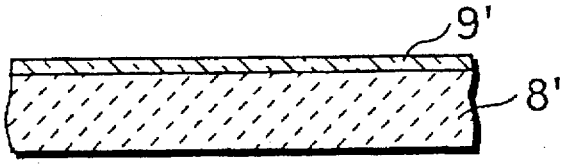

Then, as shown in FIG. 5b, a master glaze layer 9' is formed by sintering a glass paste applied over the master substrate 8'.

Figure 5C:
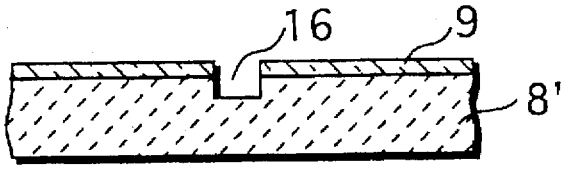

Then, as shown in FIG. 5c, a groove 16 which extends into the thickness of the master substrate 8' is formed with the use of a dicing cutter (not shown) which cuts through the master glaze layer 9' along a predetermined longitudinal division line DL1. As a result, the master glaze layer 9' is divided into separate glaze layers 9.

Figure 5D:
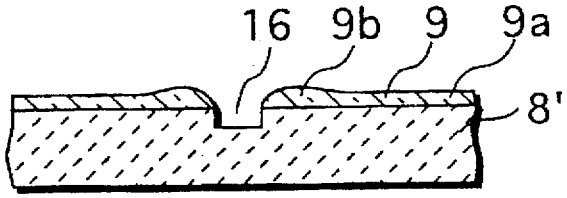

Then, as shown in FIG. 5d, a flat portion 9a and a convex portion 9b adjacent to the groove 16 are formed in the respective glaze layers 9 by heating the master substrate 8' at a temperature of about 850° C. for about 20 minutes. The formation of the convex portion 9b is due to the surface tension of the glass material which is liquidized by the heating.

Figure 5E:
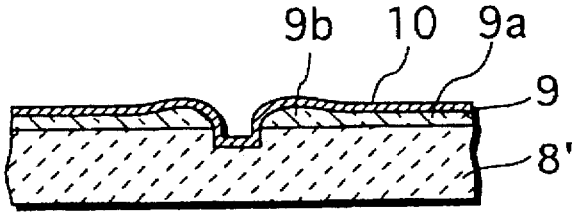

Then, as shown in FIG. 5e, a tantalum nitride-based resistor layer 10 is made in the form of a thin film having a thickness of e.g. about 0.1 μm over the glaze layers 9 by reactive sputtering. The resistor layer 10 may be formed by sputtering $TaSiO_2$.

Figure 5F:
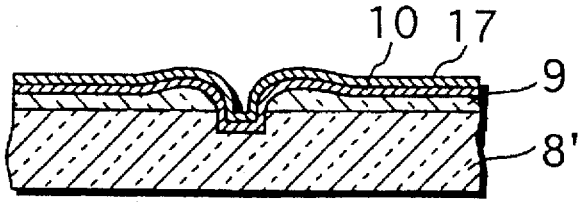

Then, as shown in FIG. 5f, a conductor layer 17 is formed over the resistor layer 10 by sputtering. Typically, the conductor layer 17 is made of aluminum (Al), while it may be made of copper (Cu) or gold (Au).

Figure 5G:
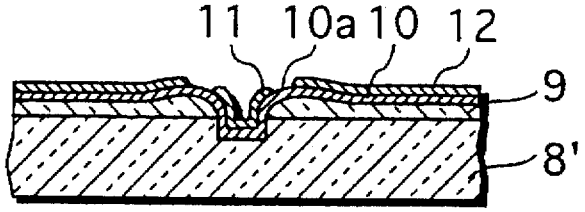

Then, as shown in FIG. 5g, upon formation of slits S (see FIG. 3) by etching the resistor layer 10 and the conductor layer 17, only the conductor layer 17 is partially removed by etching for exposure of portions of the resistor layer 10 to form heating dots 10a. As a result, the conductor layer 17 is divided into the common electrode pattern 11 and the individual electrodes 12.

Figure 5H:
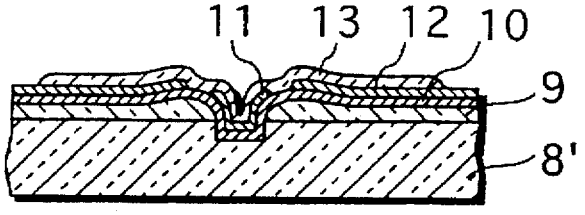

Then, as shown in FIG. 5h, a protecting layer 13 is formed by piling up an $SiO_2$ layer and a $Ta_2O_5$ layer to cover the common electrode pattern 11, the individual electrodes 12 and the exposed heating dots 10a of the resistor layer 10.

Figure 5I:
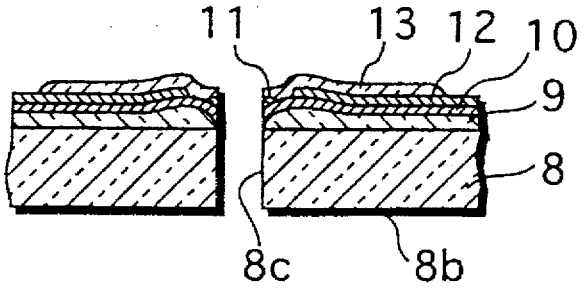

Then, as shown in FIG. 5i, the master substrate 8' is cut along the respective division lines BL1, BL2 by a dicing cutter (not shown) to provide individual head substrates 8. At this time, the common electrode pattern 11 is rendered exposed on the side of the first longitudinal edge surface 8c of each head substrate 8.

Figure 5J:
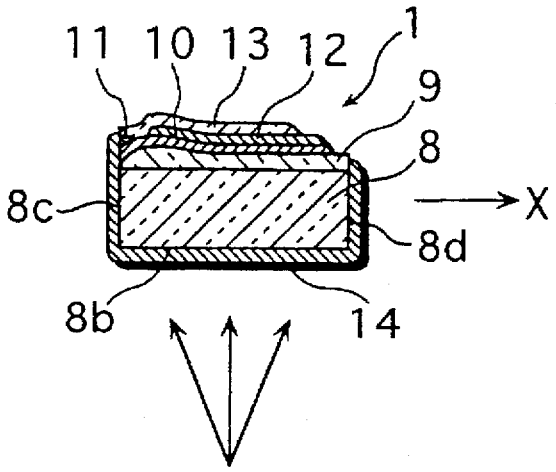

Finally, as shown in FIG. 5j, to form an auxiliary electrode layer 14 having a proper thickness (about 2 μm for example), conductive metal is provided by sputtering from below to fix on the first longitudinal edge surface 8c, reverse surface 8b and second longitudinal surface 8d of the head substrate 8, as each head substrate 8 is being moved in the direction indicated by an arrow X. In this case, the conductive metal is typically aluminum (Al), but copper (Cu) or gold (Au) may be usable.

In the method shown in FIGS. 5a–5j, the master substrate 8' is divided (FIG. 5i) after the protecting layer 13 is formed (FIG. 5h). However, it is also possible to form the protecting layer 13 after the master substrate 8' is divided first and then the auxiliary electrode layer 14 (FIG. 5j) is formed.

Figure 6:
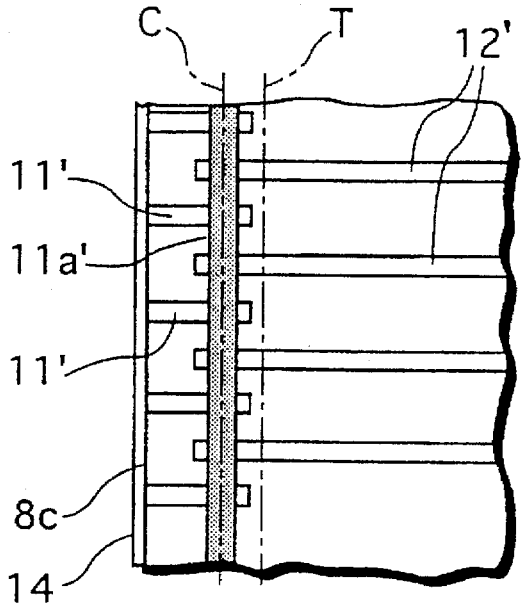
FIG. 6 is a fragmentary plan view showing a primary part of the head member of a thermal printhead according to a second embodiment of the present invention.

FIG. 6 shows a primary part of the head member of a thermal printhead according to a second embodiment of the present invention. The head member of the present embodiment comprises a common electrode pattern 11' having comb-like teeth, individual electrodes 12' being arranged in staggered relation with the respective comb-like teeth of the common electrode pattern 11' and a continuous linear thick film resistor 11a' formed to overlap on the common electrode pattern 11' and the individual electrodes 12'. With such an arrangement, the respective heating dots are constituted by a portion of the thick film resistor 11a' located between each pair of the adjacent comb-like teeth of the common electrode pattern 11'. The second embodiment is otherwise the same as the first embodiment shown in FIGS. 1–3.

Figure 7:
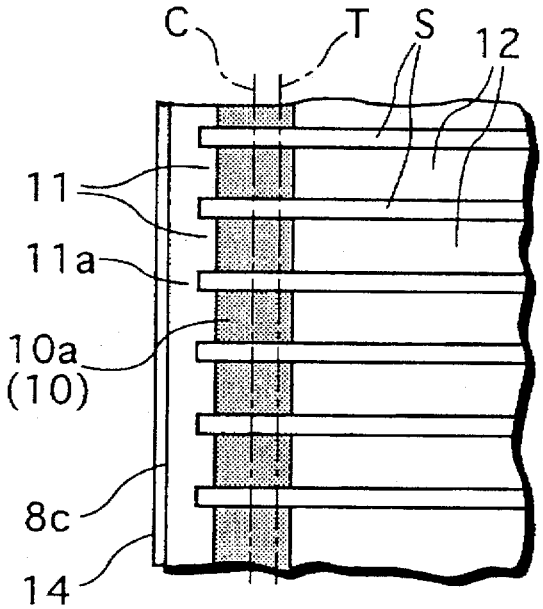
FIG. 7 is a fragmentary plan view showing a primary part of the head member of a thermal printhead according to a third embodiment of the present invention.

FIG. 7 shows a primary part of the head member of a thermal printhead according to a third embodiment of the present invention. The third embodiment is similar to the first embodiment shown in FIGS. 1–3 except only that a common electrode pattern 11 has a continuous electrode portion 11a formed on a glaze layer 3 (see FIG. 2) wherein the continuous electrode portion 11a is electrically connected to an auxiliary electrode layer 12.

Figure 8:
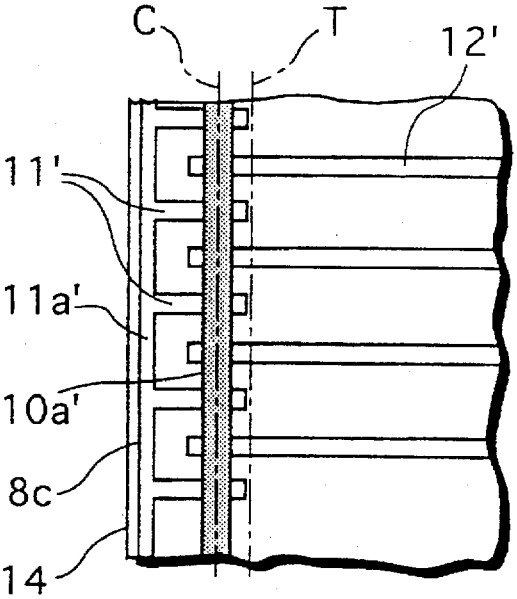
FIG. 8 is a fragmentary plan view showing a primary part of the head member of a thermal printhead according to a fourth embodiment of the present invention.

FIG. 8 shows a primary part of the head member of a thermal printhead according to a fourth embodiment of the present invention. The fourth embodiment is similar to the second embodiment shown in FIG. 2 except only that the common electrode pattern 11' made in the form of comb-like teeth has a continuous electrode portion 11a' formed on a glaze layer 3 (see FIG. 2) wherein the continuous electrode portion 11a' is electrically connected to the auxiliary electrode layer 14.

Figure 9:
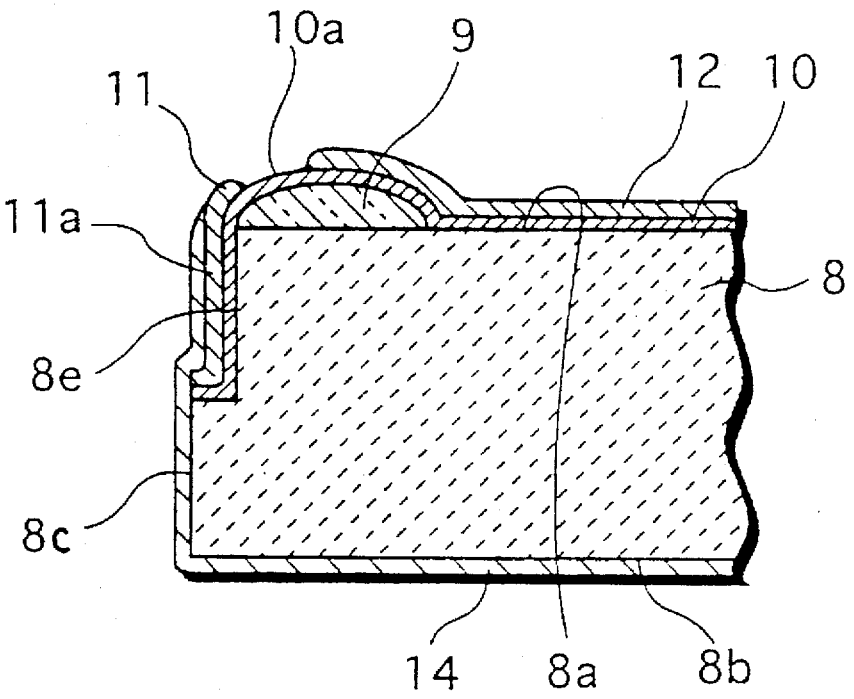
FIG. 9 is a fragmentary plan view showing a primary part of the head member of a thermal printhead according to a fifth embodiment of the present invention.
Figure 10:
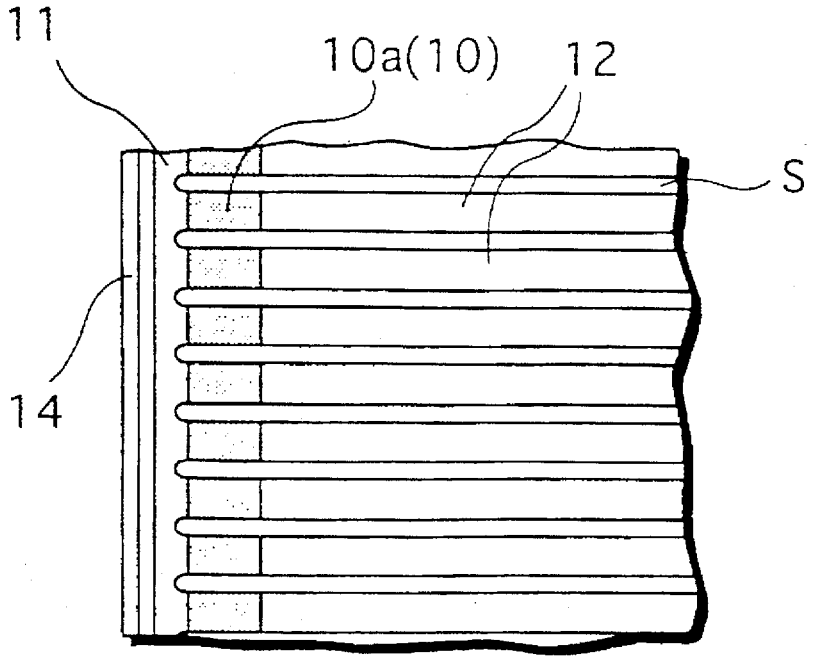
FIG. 10 is a fragmentary plan view of the head member shown in FIG. 9.

FIGS. 9 and 10 show a primary part of the head member of a thermal printhead according to a fifth embodiment of the present invention.

The head member 1 of the fifth embodiment comprises a head substrate 8 made of an insulating material such as ceramic. The head substrate 8, which is rectangular in cross section, includes an obverse surface 8a, a reverse surface 8b opposite to the obverse surface 8a, a first longitudinal edge surface 8c and a second longitudinal edge surface (not shown) opposite to the first longitudinal edge surface 8c. The surface 8a of the head substrate 8 is formed with a strip-like partial glass glaze layer 9 as a heat reservoir only in the vicinity of the first longitudinal edge surface 8a. As a result, the partial glaze layer 9 as a whole is a convex. The first edge surface 8c of the head substrate 8 is formed with a step portion 8e.

A resistor layer 10 is made in the form of a thin film to cover the obverse surface 8a of the head substrate 8 and the partial glaze layer 9, and the resistor layer 10 further extends onto the step portion 8e of the first edge surface 8c of the head substrate 8. The resistor layer 10 is divided into plural parts by slits S (see FIG. 10) which extend transversely of the head substrate 8 (that is, widthwise of the head substrate 8).

The resistor layer 10 has a surface formed with a common electrode pattern 11 adjacent to the first longitudinal edge surface 8c of the head substrate 8 and with individual electrodes 12 which are spaced from the common electrode pattern 11 and extend from the partial glaze layer 9 toward the second longitudinal edge surface (not shown) of the head substrate 8. The common electrode pattern 11 has a continuous electrode portion 11a which extends onto the step portion 8e of the first longitudinal edge surface 8c of the head substrate 8. The individual electrodes 12 are spaced from each other by the slits S.

As described above, the individual electrodes 12 are spaced from the common electrode pattern 11. Therefore, the resistor layer 10 is exposed between the common electrode pattern 11 and the individual electrodes 12, so that the exposed portions constitute heating dots (heating regions) 10*a* linearly extending along the first longitudinal edge surface 8*c* of the head substrate 8. Like the first embodiment shown in FIGS. 1–3, the heating dots 10*a* are made to slightly deviate from the apex of the partial glaze layer 9 toward the first longitudinal edge surface 8*c* (step portion 8*e*) of the head substrate 8.

The continuous electrode portion 11*a* of the common electrode pattern 11 extending onto the step portion 8*e* of the head substrate 8 is electrically connected to the auxiliary electrode layer 14 which also extends onto the step portion 8*e*. The auxiliary electrode layer 14 covers all of the first longitudinal edge surface 8*c*, reverse surface 8*b* and second longitudinal edge surface (not shown) of the head substrate 8. Thus, the auxiliary electrode layer 14 has a large area, thereby enlarging current passage and substantially eliminating a voltage drop in the longitudinal direction of the head member. Further, the continuous electrode portion 11*a* extending onto the step portion 8*e* of the head substrate 8 serves to enlarge a contacting area with the auxiliary electrode layer 14, thereby improving electrical connection between them. Further, since the continuous electrode portion 11*a* extends onto the step portion 8*e* of the head substrate 8, the area contacting with the auxiliary electrode layer 14 can be enlarged, thereby improving the electrical connection between them and also enlarging the current passage correspondingly due to the portion of the continuous electrode portion 11*a* extending onto the step portion 8*e*.

Although not shown, in the fifth embodiment, the heating regions (heating dots) 10*a* of the resistor strip 10, the common electrode pattern 11 and the individual electrodes 12 are covered with a protecting layer 13.

Next, a preferred method of making the head member of the fifth embodiment will be described with reference to FIGS. 11*a*–11*g*.

Figure 11A:
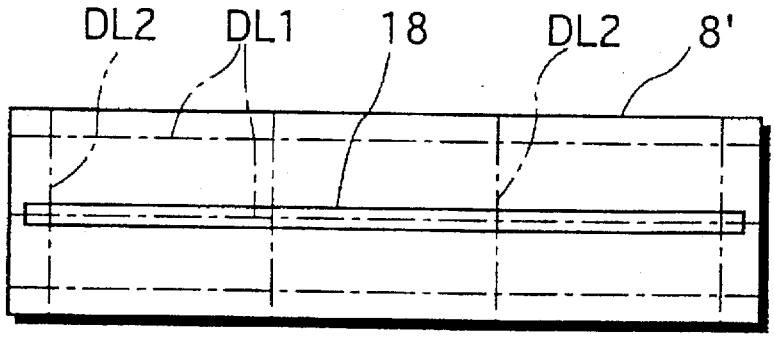
FIGS. 11*a*–11*g* show sequential steps for making the head member shown in FIGS. 9 and 10.

First, as shown in FIG. 11*a*, an alumina-ceramic master substrate 8' is prepared which is large enough to provide a plurality of head substrates when the master substrate 8' is later divided along longitudinal division lines DL1 and transverse division lines DL2. The master substrate 8' comprises a slit 18 extending along a predetermined longitudinal division line DL1.

Figure 11B:
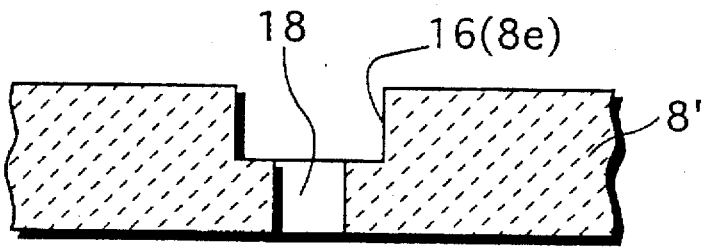

Then, as shown in FIG. 11*b*, a groove 16 is formed in the master substrate 8' along the slit 18 by a dicing cutter (not shown). The groove 16 will constitute the step portion 8*e*.

Figure 11C:
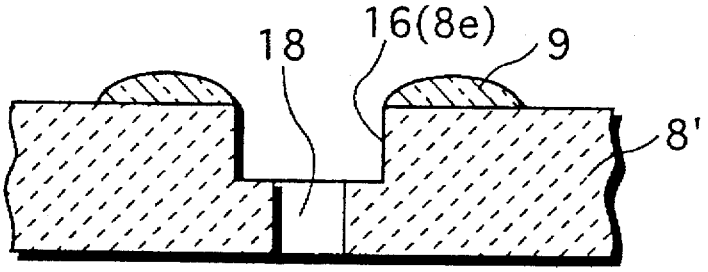

Then, as shown in FIG. 11*c*, partial glaze layers 9 are formed by sintering glass paste applied on the master substrate 8' adjacently to the groove 16.

Figure 11D:
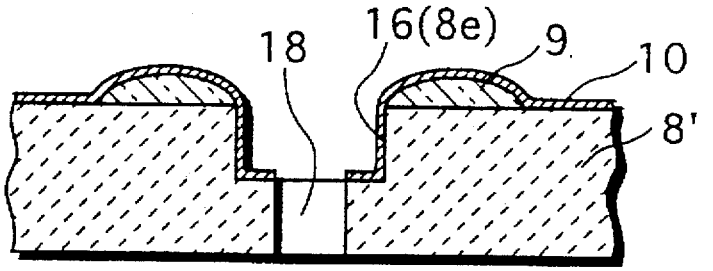

Then, as shown in FIG. 11*d*, resistor layers 10 are made in the form of a thin film by sputtering $TaSiO_2$ over the partial glaze layers 9 and the master substrate 8'. As a result, the resistor layers 10 are formed to extend over the inner walls of the groove 16 of the master substrate 8'.

Figure 11E:
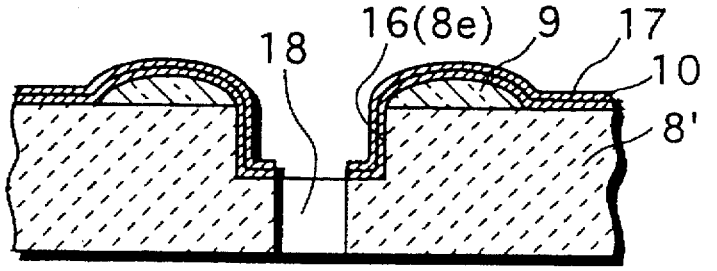

Then, as shown in FIG. 11*e*, conductor layers 17 are formed over the resistor layers 10 by sputtering. The conductor layers 17 also extend over the inner walls of the groove 16 of the master substrate 8'. Typically, the conductor layers 17 are made of aluminum (Al), but copper (Cu) or gold (Au) may be used.

Figure 11F:
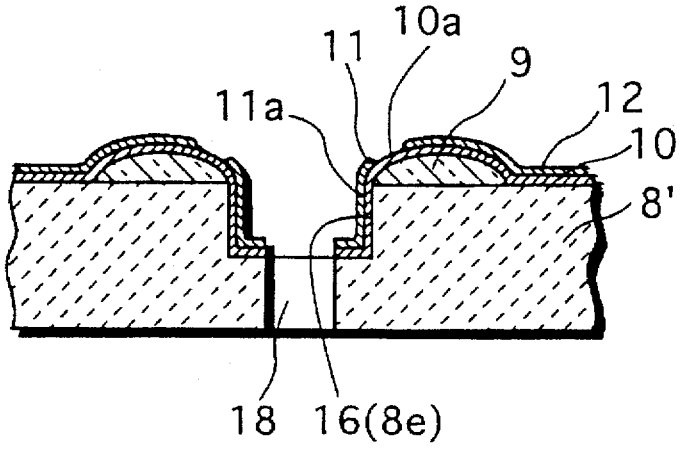

Then, as shown in FIG. 11*f*, upon formation of slits S (see FIG. 10) by etching the resistor layers 10 and the conductor layers 17, the conductor layers 17 are partially removed by etching to expose portions of the resistor layers 10 to be heating dots 10*a*. As a result, the conductor layer is divided into a common electrode pattern 11 and individual electrodes 12.

Figure 11G:
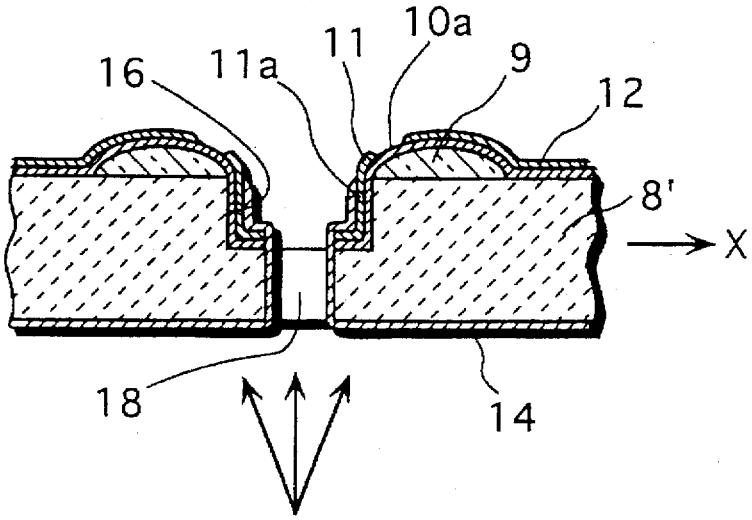

Then, as shown in FIG. 11*g*, auxiliary electrode layers 14 having a proper film thickness are formed by sputtering conductive metal (e.g. aluminum or copper) from below, as the master substrate 8' is being moved in the direction indicated by an arrow X. At this time, the auxiliary electrode layers 14 are formed to extend over the inner walls of the slit 18 and groove 16, thereby being electrically connected to the common electrode patterns 11. The film thickness of the portion of the auxiliary electrode layer 14 extending over the inner walls of the slit 18 and groove 16 can be controlled by the width of the slit 18.

Finally, although not shown, upon formation of protecting layers, the master substrate 8' is cut along the respective division lines BL1, BL2 to provide individual head members.

Figure 12:
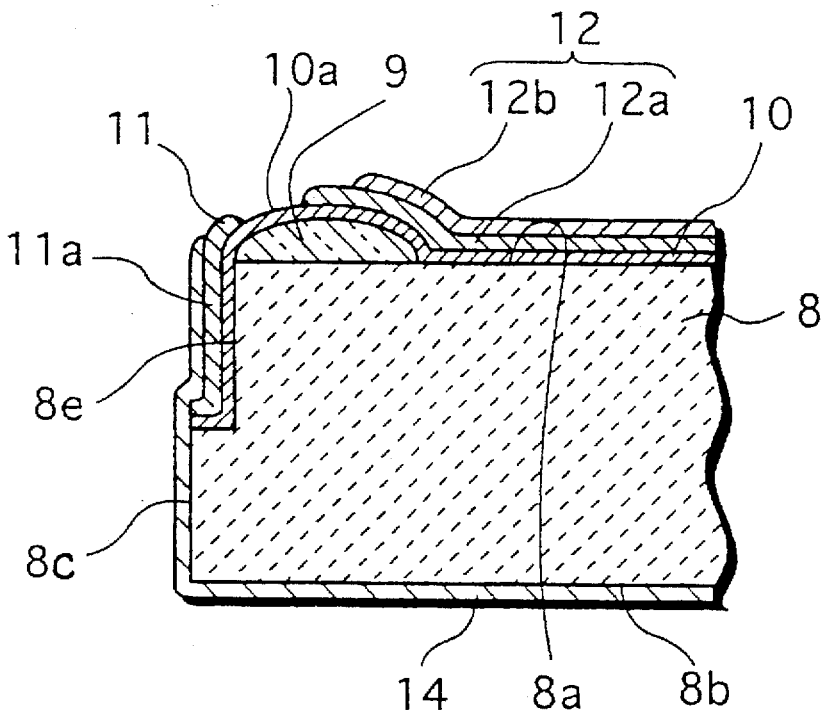
FIG. 12 is a fragmentary sectional view showing a primary part of the head member of a thermal printhead according to a sixth embodiment of the present invention.
Figure 13:
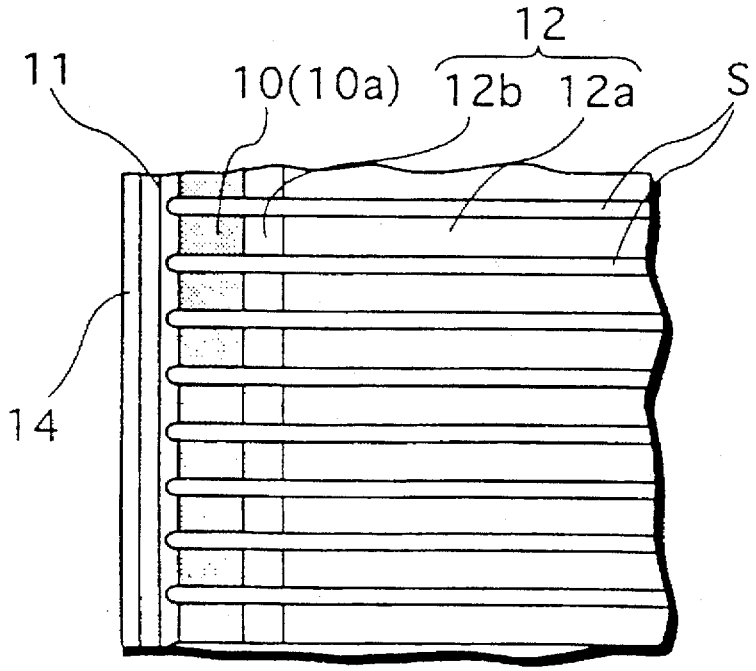
FIG. 13 is a fragmentary plan view of the head member shown in FIG. 12.

FIGS. 12 and 13 show primary parts of the head member of a thermal printhead according to a sixth embodiment of the present invention. The head member of the sixth embodiment is similar to the head member of the fifth embodiment (see FIGS. 9 and 10) except for the following respects.

First, a common electrode pattern 11 is made of chromium (Cr), which has higher thermal stability, not of aluminum or copper. The common electrode pattern 11 thus made of chromium is advantageous not only in that it is easily connected to the resistor layer 10 and the auxiliary electrode layer 14 (made of e.g. aluminum), but also in that it is hardly deteriorated by heat.

Secondly, the individual electrode 12 is made to have a double-layer structure which comprises a first layer 12*a* made of chromium and a second layer 12*b* made of a different metal (e.g. aluminum or copper), wherein the second layer 12*b* is made to extend only up to a point short of the extent to which the first layer 12*a* extends. With such an arrangement, it is advantageous that the individual electrodes 12 can be easily attached to the resistor layer 10, and that the first layer 12*a* is hardly deteriorated by heat. Further, since the first layer 12*a* made of chromium can be formed relatively thin and the second layer 12*b* extends only to a point short of the extent to which the first layer 12*a* extends, a printing medium backed up by the platen (not shown) can have easy access to the heating dots 10*a*, thereby improving the printing quality.

The first layer 12*a* of the individual electrode 12 and the common electrode pattern 11 are simultaneously formed by etching. The common electrode pattern 11 may be formed to have a double-layer structure like the individual electrodes 12.

The present invention is described above on the basis of the preferred embodiments. However, the present invention is not limited to these embodiments. For instance, for each method of making the head member, not only sputtering but also other methods such as CVD are applicable as a film-making method for the resistor layer, the common electrode pattern, the individual electrodes and the auxiliary electrode layer. Further, materials and configurations of the head substrate, support board and other composing elements are not limited to those of the embodiments. Still further, by enlarging the width of the head substrate, the drive ICs may be mounted on the head substrate, without providing a separate support board.

We claim:

1. A thermal printhead comprising:

an insulating head substrate having an obverse surface, a reverse surface, a first longitudinal edge surface and a second longitudinal edge surface;

an array of heating dots formed on the obverse surface of the head substrate along the first longitudinal edge surface;

a common electrode pattern electrically connected to the array of heating dots on the obverse surface of the head substrate adjacent to the first longitudinal edge surface;

individual electrodes formed on the obverse surface of the head substrate to extend away from the common electrode pattern, the individual electrodes being electrically connected to the respective heating dots; and drive means for selectively actuating the heating dots to generate heat;

wherein the common electrode pattern is electrically connected to an auxiliary electrode layer which covers at least the first longitudinal edge surface of the head substrate; and wherein the first longitudinal edge surface of the head substrate has a step portion which is defined by a first surface extending from the obverse surface of the head substrate toward the reverse surface thereof and a second surface extending from the first surface of the step portion in parallel to the reverse surface of the substrate, the common electrode extending onto the step portion partially in parallel to the first surface thereof and partially in parallel to the second surface thereof, the auxiliary electrode layer also extending on the step portion for electrical connection to the common electrode pattern.

2. The thermal printhead according to claim 1, wherein the auxiliary electrode layer also covers the reverse surface of the head substrate.

3. The thermal printhead according to claim 1, wherein the auxiliary electrode layer also covers the reverse surface and second longitudinal edge surface of the head substrate.

4. The thermal printhead according to claim 1, wherein the array of heating dots is constituted by a resistor layer extending onto the first and second surfaces of the step portion in direct contact therewith.

5. The thermal printhead according to claim 1, wherein the obverse surface of the head substrate is formed with a glaze layer having a convex portion adjacent to the first longitudinal edge surface, the array of heating dots being formed on the convex portion of the glaze layer, the array of heating dots having a center line which positionally deviates from an apex line of the convex portion toward the first longitudinal edge surface of the head substrate.

6. The thermal printhead according to claim 5, wherein the glaze layer covers substantially entirely the obverse surface of the head substrate and has a flat portion continuous with the convex portion.

7. The thermal printhead according to claim 5, wherein the glaze layer is a partial glaze layer having only the convex portion.

8. The thermal printhead according to claim 1, wherein the head substrate and the drive means are juxtaposed on a separate insulating support board.

9. The thermal printhead according to claim 1, wherein the array of heating dots is constituted by a thin film resistor layer patterned on the obverse surface of the head substrate, the common electrode pattern and individual electrodes being formed on the resistor layer.

10. The thermal printhead according to claim 9, wherein the common electrode pattern comprises a layer made of chromium.

11. The thermal printhead according to claim 9, wherein the individual electrodes comprises a first layer made of chromium and a second layer made of a metal other than chromium.

12. The thermal printhead according to claim 11, wherein the second layer extends toward the array of heating dots but only up to a point short of the extent to which the first layer extends.

13. The thermal printhead according to claim 1, wherein the array of heating dots is constituted by a continuous thick film resistor formed in a line.

* * * * *